US009073176B2

(12) United States Patent
Kobayashi et al.

(10) Patent No.: US 9,073,176 B2
(45) Date of Patent: Jul. 7, 2015

(54) METHOD FOR SHOT-PEENING AND A SHOT-PEENING MACHINE

(75) Inventors: Yuji Kobayashi, Toyokawa (JP); Toshiya Tsuji, Toyokawa (JP)

(73) Assignee: SINTOKOGIO, LTD., Nagoya-Shi (JP)

( * ) Notice: Subject to any disclaimer, the term of this patent is extended or adjusted under 35 U.S.C. 154(b) by 231 days.

(21) Appl. No.: 13/812,094

(22) PCT Filed: Apr. 22, 2011

(86) PCT No.: PCT/JP2011/059933

§ 371 (c)(1),
(2), (4) Date: Jan. 24, 2013

(87) PCT Pub. No.: WO2012/014542

PCT Pub. Date: Feb. 2, 2012

(65) Prior Publication Data

US 2013/0125600 A1 May 23, 2013

(30) Foreign Application Priority Data

Jul. 27, 2010 (JP) ..... 2010-168545

(51) Int. Cl.
*B24C 1/10* (2006.01)
*B24C 1/08* (2006.01)

(52) U.S. Cl.
CPC .... *B24C 1/10* (2013.01); *B24C 1/08* (2013.01)

(58) Field of Classification Search
CPC ..... B24C 1/10; B24C 1/08
USPC ..... 72/53; 148/580, 908; 29/90.7; 451/38, 451/39
See application file for complete search history.

(56) References Cited

U.S. PATENT DOCUMENTS 3,073,022 A * 1/1963 Bush et al. ..... 72/53
4,428,213 A * 1/1984 Neal et al. ..... 72/53

(Continued)

FOREIGN PATENT DOCUMENTS

JP 10-251748 9/1998
JP 2002-030344 1/2002
JP 2009-226523 10/2009

OTHER PUBLICATIONS

English-language International Search Report from the Japanese Patent Office for International Application No. PCT/JP2011/059933, mailing date Jul. 26, 2011.

(Continued)

*Primary Examiner* — David B Jones

(74) *Attorney, Agent, or Firm* — Finnegan, Henderson, Farabow, Garrett & Dunner, L.L.P.

(57) ABSTRACT

The cost for shot-peening is intended to be reduced. The method for shot-peening of the present invention comprises a first step for processing a work by shot-peening by projecting shots onto the work, and a second step for processing the work by shot-peening by projecting the shots onto the work at a speed for projecting the shots that is slower than the speed in the first step, wherein the second step uses the same shot-peening machine and same shots that have been used in the first step. By this method, an intended distribution of compressive residual stresses is obtained by the processes in the first and second steps and the surface roughness of the work is decreased by the process in the second step wherein the shots are projected at the speed that is slower than that in the first step. Further, no removal or supply of the shots and no re-setting of the conditions for the process that are related to the removal and supply of the shots are required. Multiple shot-peening machines do not need to be installed. Thus the cost for shot-peening is reduced.

6 Claims, 7 Drawing Sheets

(56) References Cited

U.S. PATENT DOCUMENTS

| | | | | |
|---|---|---|---|---|
| 5,665,179 | A * | 9/1997 | Izawa et al. | 148/226 |
| 6,346,157 | B1 * | 2/2002 | Takezawa et al. | 148/580 |
| 8,308,150 | B2 * | 11/2012 | Tange et al. | 267/286 |
| 8,468,862 | B2 * | 6/2013 | Ganesh | 72/53 |
| 8,533,954 | B2 * | 9/2013 | Tange et al. | 29/896.9 |
| 8,607,605 | B2 * | 12/2013 | Tange et al. | 72/53 |

OTHER PUBLICATIONS

Office Action for JP Application No. 2012-526354 dated Oct. 28, 2014.

* cited by examiner

METHOD FOR SHOT-PEENING AND A SHOT-PEENING MACHINE

TECHNICAL FIELD

The present invention relates to a method for shot-peening and a shot-peening machine.

BACKGROUND ART

Japanese Patent Laid-open Publication No. 2002-30344 discloses a method for shot-peening, wherein a work is processed by shot-peening that uses shots that are large in diameter, and then it is processed by shot-peening that uses shots that are small in diameter, so that a high residual stress is generated just below the surface of the work and the surface roughness is decreased.

DISCLOSURE OF INVENTION

If those processes by shot-peening are carried out by one shot-peening machine, shots that are large in diameter must be removed after the process by shot-peening that uses the large shots. Further, after that, shots that are small in diameter must be supplied and the conditions for the shot-peening must be adjusted for the shots. Thus a long time is needed to complete the series of the processes, resulting in increasing the cost.

In contrast, respective shot-peening machines to which shots that are large in diameter are supplied and to which shots that are small in diameter are supplied may be installed to decrease the time for changing the shots and for re-setting the conditions for the processes by using the respective shot-peening machines. However, in this case, since multiple shot-peening machines are required, the initial cost increases.

In view of these problems, the object of the present invention is to provide a method. for shot-peening and a shot-peening machine that reduce the cost for shot-peening.

To solve the problems, a method for shot-peening of the first embodiment of the present invention comprises a first step to process a work by shot-peening, wherein the shots are projected onto the work by a shot-peening machine. It also comprises a second step to process the work by shot-peening after the first step, wherein the shots are projected onto the work by the shot-peening machine at a speed for projecting the shots that is slower than that in the first step. The shots and the shot-peening machine that have been used in the first step are used in the second step.

By this method, an intended distribution of compressive residual stresses can be obtained by the processes of the first and second steps. Further, the surface roughness can be decreased by the process of the second step wherein the shots are projected at a speed that is slower than that in the first step.

To process the work by shot-peening, the required operation is just to change the speed for projecting the shots. No removal or supply of the shots is required. Further, no re-setting of the conditions for the processes that is related to the removal and supply of the shots is required. Further, multiple shot-peening machines do not need to be installed. Thus the cost for shot-peening is reduced.

To solve the problems, the shot-peening machine of the second embodiment of the present invention comprises a projecting unit that is configured to project shots onto a work and is able to change the speed for projecting the shots. It also comprises a control unit. The control unit carries out a step of storing a first speed for projecting the shots and a second speed for projecting the shots that is slower than the first speed, a step of a first control, and a step of a second control. The step of the first control controls the projecting unit so as to project the shots toward the work at the first speed that has been stored in the step of storing to process the work by shot-peening. The step of the second control controls the projecting unit so as to project the shots toward the work at the second sped that has been stored in the step of storing to process the work by shot-peening after the step of the first control.

By using that shot-peening machine, the work can be processed by shot-peening wherein the shots are projected toward the work at the first speed for projecting the shots, and thereafter the shots are projected toward the work at the second speed for projecting the shots that is slower than the first speed for projecting the shots. Thus an intended distribution of compressive residual stresses is obtained by processing at the first and second speeds for projecting the shots and the surface roughness of the work is decreased by the process at the second speed for projecting the shots that is slower than the first speed for projecting the shots.

To process the work by shot-peening, the required operation is just to change the speed for projecting the shots. No removal or supply of the shots is required. Further, no re-setting of the conditions for the processes that are related to the removal and supply of the shots is required. Further, multiple shot-peening machines do not need to be installed. Thus the cost for shot-peening is reduced.

To solve the problems, the shot-peening machine of the third embodiment of the present invention comprises a first projecting unit for projecting shots toward a work at a first speed for projecting the shots to process the work by shot-peening, and a second projecting unit for projecting the shots toward the work at a second speed for projecting the shots that is slower than the first speed for projecting the shots to process the work by shot-peening after the first projecting unit projects the shots onto the work to process the work by shot-peening. The shots used by the second projecting unit have been used for the shot-peening by the first projecting unit.

By using that shot-peening machine, the work can be processed by shot-peening wherein the shots are projected toward the work at the first speed for projecting the shots, and thereafter the shots are projected toward the work at the second speed for projecting the shots that is slower than the first speed for projecting the shots. This an intended distribution of compressive residual stresses is obtained by processing at the first and second speeds for projecting the shots and the surface roughness of the work is decreased by the process at the second speed for projecting the shots that is slower than the first speed for projecting the shots.

To process the work by shot-peening, the required operation is just to change the speed for projecting the shots. No removal or supply of the shots is required. Further, no re-setting of the conditions for the processes that are related to the removal and supply of the shots is required. Further, multiple shot-peening machines do not need to be installed. Thus the cost for shot-peening is reduced.

As discussed above, by the present invention the cost for shot-peening is reduced.

The basic Japanese patent application, No. 2010-168545, filed Jul. 27, 2010, is hereby incorporated by reference in its entirety in the present application. The present invention will become more fully understood from the detailed description given below. However, the detailed description and the specific embodiments are only illustrations of desired embodiments of the present invention, and so are given only for an explanation. Various possible changes and modifications will be apparent to those of ordinary skill in the art on the basis of the detailed description. The applicant has no intention to dedicate to the public any disclosed embodiment. Among the disclosed changes and modifications, those which may not literally fall within the scope of the present claims constitute, therefore, a part of the present invention in the sense of the doctrine of equivalents. The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

BEST MODE FOR CARRYING OUT THE INVENTION

First Embodiment

First, the first embodiment of the present invention is described.

Figure 1:
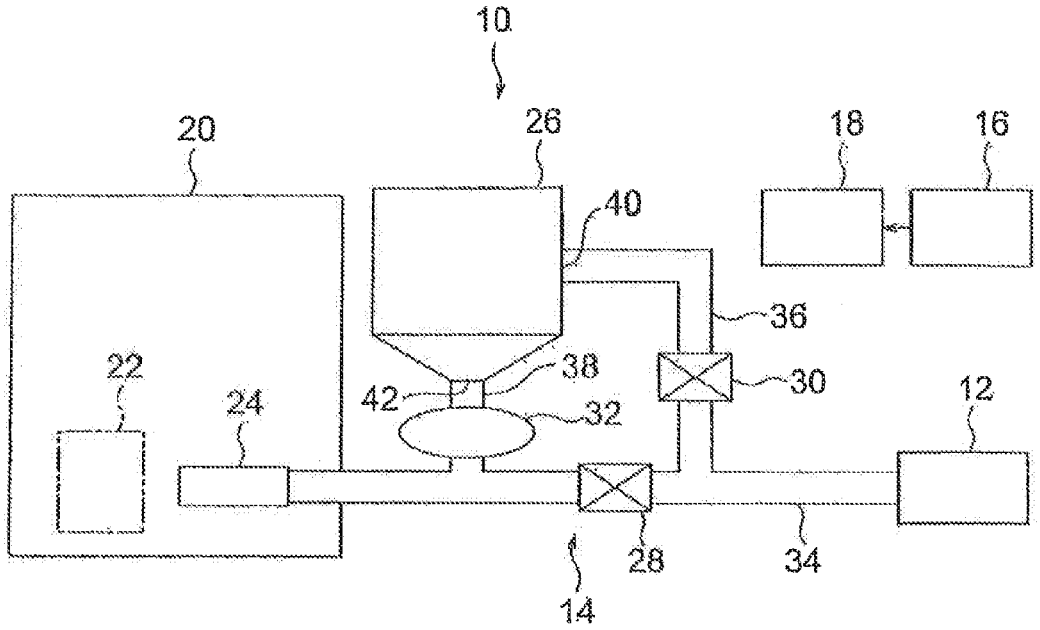
FIG. 1 is a block diagram of the shot-peening machine according to the first embodiment of the present invention.

As in FIG. 1, the shot-peening machine 10 that is the first embodiment of the present invention comprises a device 12 for supplying compressed air, a projecting unit 14, an operating unit 16, a control unit 18, and a case 20.

The projecting unit 14 is used to project shots onto a work 22 that is housed in the case 20. It comprises a nozzle 24, a tank 26, flow control valves 28, 30, a valve 32 for controlling the amount of shots, and connecting piping 34, 36, 38.

The connecting piping 34 is connected to the device 12 for supplying compressed air. The nozzle 24 is attached to the end of the connecting piping 34. The nozzle 24 is located within the case 20 so that its jetting port faces the work 22. The middle portion in the longitudinal direction of the connecting piping 34 is connected to an inlet 40 of the tank 26 via the connecting piping 36. An outlet 42 of the tank 26 is connected to a point of the connecting piping 34 between the point to connect to the connecting piping 36 and the nozzle 24. A shutoff valve, which is not shown, is provided at the outlet 42 of the tank 26. The tank 26 is configured to store the shots.

The flow control valves 28, 30 consist of, for example, electric pneumatic regulators. The flow control valve 28 is located at the point on the connecting piping 34 that is located between the respective connections to the connecting piping 36 and to the connecting piping 38. The flow control valve 30 is located at the middle portion in the longitudinal direction of the connecting piping 36. The valve 32 for controlling the amount of shots consists of, for example, a Magna Valve or a mixing valve. It is located at the middle portion in the longitudinal direction of the connecting piping 38.

The operating unit 16 is configured so that the conditions to process the work 22 by shot-peening can be input. It is constructed to output signals to the control unit 18 based on the input. The control unit 18 consists of, for example, a memory, an arithmetic processing unit, etc. It controls the device 12 for supplying compressed air, the flow control valves 28, 30, the valve 32 for controlling the amount of shots, the shutoff valve, which is not shown, etc., based on the signals output by the operating unit 16.

As discussed below, the shot-peening machine 10 is configured to process the work 22 by shot-peening at a first pressure for projecting the shots and then to process the work 22 by shot-peening at a second pressure for projecting the shots that is lower than the first pressure for projecting the shots.

Thus the first and second pressures of projecting can be input to the operating unit 16. The control unit 18 stores in the memory the conditions for the process that include the first and second pressures of projecting, which conditions are input to the operating unit 16. Further, the control unit 18 stores a program to process the work 22 by shot-peening based on the conditions for the process that are input to the operating unit 16 prior to the process being carried out.

Next, a method for processing the work 22 by shot-peening by using the shot-peening machine 10 is described.

First, an operator inputs the conditions for the process to the operating unit 16. The conditions for the process include the first pressure for projecting the shots and the second pressure for projecting the shots. After the conditions for the process are input to the operating unit 16 those conditions are stored in the control unit 18. The process by the control unit 18 for storing the conditions for the process that include the first and second pressures of projecting corresponds to the step for storing of the present invention.

When a switch for starting the machine, which is not shown, is actuated, for example, the control unit 18 activates the device 12 for supplying compressed air. When the device 12 for supplying compressed air is activated, compressed air that is supplied from the device 12 is supplied to the tank 26 via the connecting piping 34, 36 to pressurize the tank 26.

Then the shutoff valve, which is not shown, is opened so that compressed air and shots are jetted from the tank 26 to the connecting piping 38. The compressed air and shots join compressed air that is supplied through the connecting piping 34 to be jetted from the nozzle 24 via the connecting piping 34. Thus the shots are projected onto the work 22 in this way.

At the same time, the control unit 18 controls the flow control valves 28, 30 and the valve 32 for controlling the amount of shots. That is, the control valves 28, 30 are controlled so that the shots are projected from the nozzle 24 at the first pressure for projecting the shots. The valve 32 for controlling the amount of shots is controlled so that the amount of the shots is suitable to the first pressure for projecting the shots. At this time, the amount of the shots per time is controlled so as to maintain the concentration of the shots in the compressed air, i.e., a mixing ratio, at a predetermined level that is determined based on the kind of work 22.

Since the shots are projected onto the work 22 in this way, the work 22 is processed by shot-peening at the first pressure for projecting the shots. The above process corresponds to the first process of the present invention. The process by the control unit 18 in the first process corresponds to the step of the first control on the present invention.

The shots that have been projected onto the work 22 are returned to the tank 26 by a mechanism for recovering shots, which is not shown.

Then, after the work 22 has been processed by shot-peening at the first pressure for projecting the shots in this way, the control unit 18 changes the controls of the control valves 28, 30 and the valve 32 for controlling the amount of shots. That is, the control valves 28, 30 are controlled so that the shots are projected from the nozzle 24 at the second pressure for projecting the shots that is lower than the first pressure for projecting the shots. The valve 32 for controlling the amount of shots is controlled so that the amount of the shots is suitable for the second pressure for projecting the shots. At this time as well, the amount of the shots per unit of time is controlled so as to maintain the mixing ratio at a predetermined level.

Since the shots are projected onto the work 22 in this way, the work 22 is processed by shot-peening at the second pressure for projecting the shots. The above process corresponds to the second process of the present invention. The process by the control unit 18 in the second process corresponds to the step of the second control in the present invention. By this shot-peening machine 10, no removal or supply of the shots is carried, out, but the same shots are used.

By this shot-peening machine 10, after the work 22 is processed by shot-peening by projecting the shots at the first pressure for projecting the shots, it is processed by shot-peening by projecting the shots at the second pressure for projecting the shots that is lower than the first pressure for projecting the shots.

The speed of projecting is proportional to the pressure for projecting the shots. Thus by the shot-peening machine 10, after the work 22 is processed by shot-peening by projecting the shots at a first speed for projecting the shots, it is processed by shot-peening by projecting the shots at the second speed for projecting the shots that is slower than the first speed for projecting the shots.

Next, the functions and advantageous effects of the first embodiment of the present invention are discussed.

By this shot-peening machine 10, after the work 22 is processed by shot-peening by projecting the shots at the first pressure for projecting the shots, it is processed by shot-peening by projecting the shots at the second pressure for projecting the shots that is lower than the first pressure for projecting the shots. Thus, while an intended distribution of compressive residual stresses is obtained by the process at the first pressure for projecting the shots and the process at the second pressure for projecting the shots, the surface roughness of the work 22 is decreased by the process at the second pressure for projecting the shots that is lower than the first pressure for projecting the shots.

To process the work by shot-peening, the required operation is just to change the pressure for projecting the shots. No removal or supply of the shots is required. Further, no resetting of the conditions for the processes that is related to removal or supply of the shots is required. Further, multiple shot-peening machines do not need to be installed. Thus the cost for shot-peening is reduced.

Figure 8:
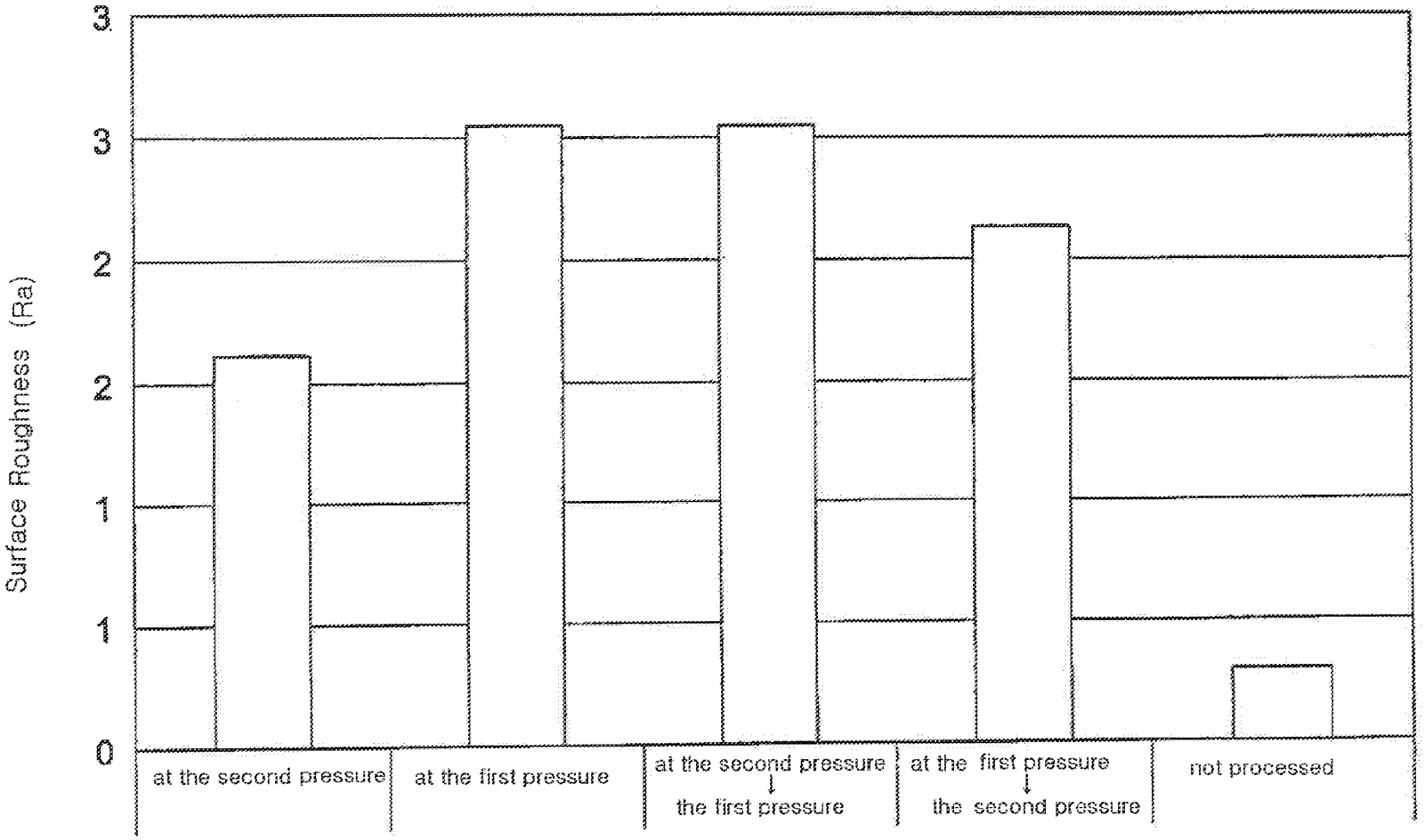
FIG. 8 shows the measurements of the surface roughness of the work when the pressure by shots is changed.

FIG. 8 shows the measurements of the surface roughness (Ra) of the work that has been processed at the second pressure for projecting the shots, at the first pressure for projecting the shots, at the pressure that is changed from the second pressure for projecting the shots to the first pressure for projecting the shots, and at the pressure that is changed from the first pressure for projecting the shots to the second pressure for projecting the shots, and of the work that has not been processed. As an example, the first pressure for projecting the shots is 0.5 MPa and the second pressure for projecting the shots is 0.1 MPa. As is seen from the figure, the surface roughness of the work that has been processed at the pressure that is changed from the first pressure for projecting the shots to the second pressure for projecting the shots is smaller than the surface roughness of the works that have been processed at the first pressure for projecting the shots and at the pressure that is changed from the second pressure for projecting the shots to the first pressure for projecting the shots. That is, by processing the work at the second pressure for projecting the shots that is lower than the first pressure after it was processed by shot-peening at the first pressure, the surface roughness is decreased.

Figure 9:
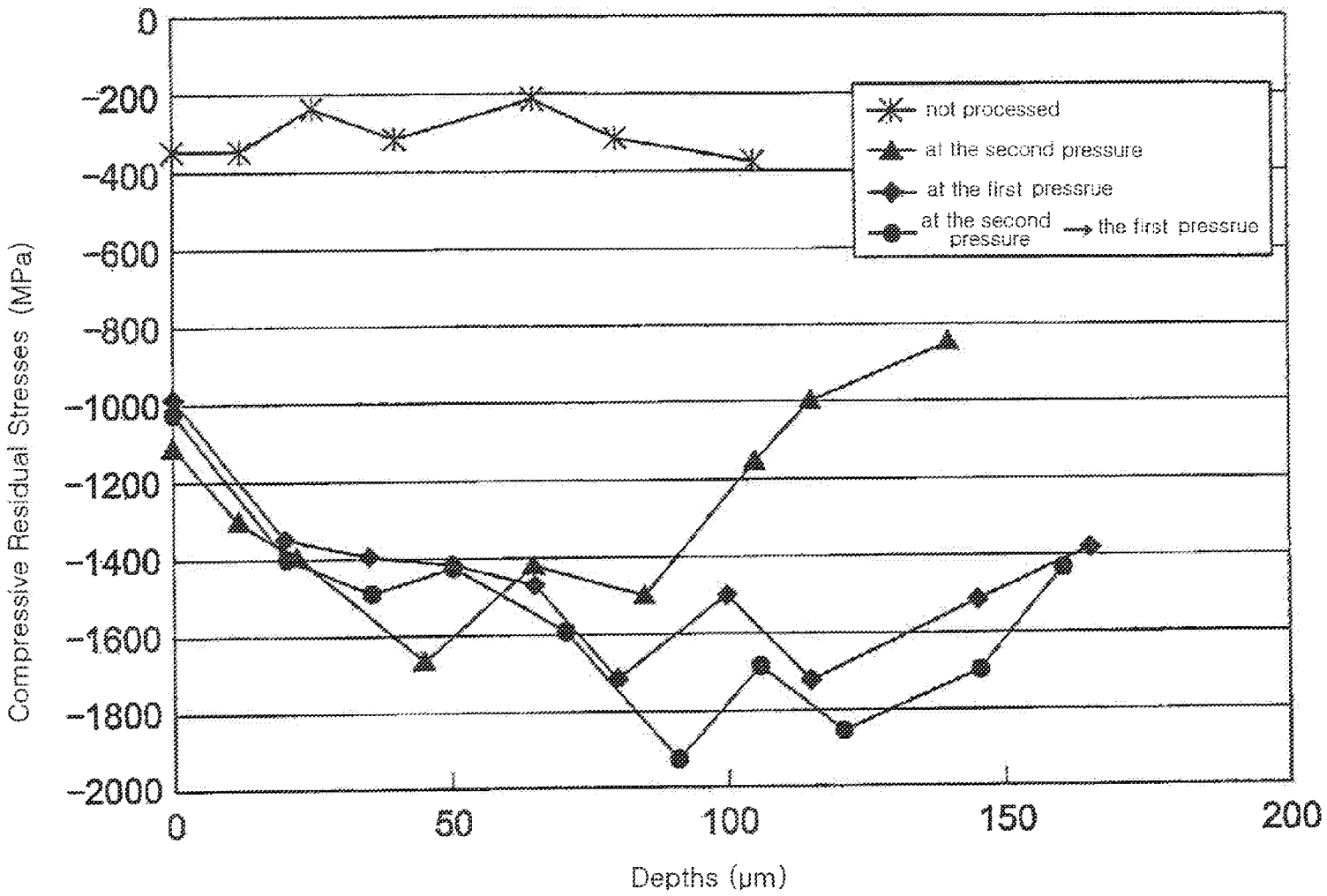
FIG. 9 shows the distributions in depth of the measurements of the compressive residual stresses of the work when the pressure by shots is changed.

FIG. 9 shows the distributions in depth of the measurements of the compressive residual stresses of the work that has not been processed and of the works that have processed at the second pressure for projecting the shots, at the first pressure for projecting the shots, and at the pressure that is changed from the second pressure for projecting the shots to the first pressure for projecting the shots. As seen from the figure, the distribution of the measurements of the compressive residual stresses of the work that has been processed at the pressure that is changed from the second pressure for projecting the shots to the first pressure for projecting the shots is almost the same as that of the work that has been processed at the first pressure for projecting the shots. Thus no effect is obtained by changing the pressure for projecting the shots.

Figure 10:
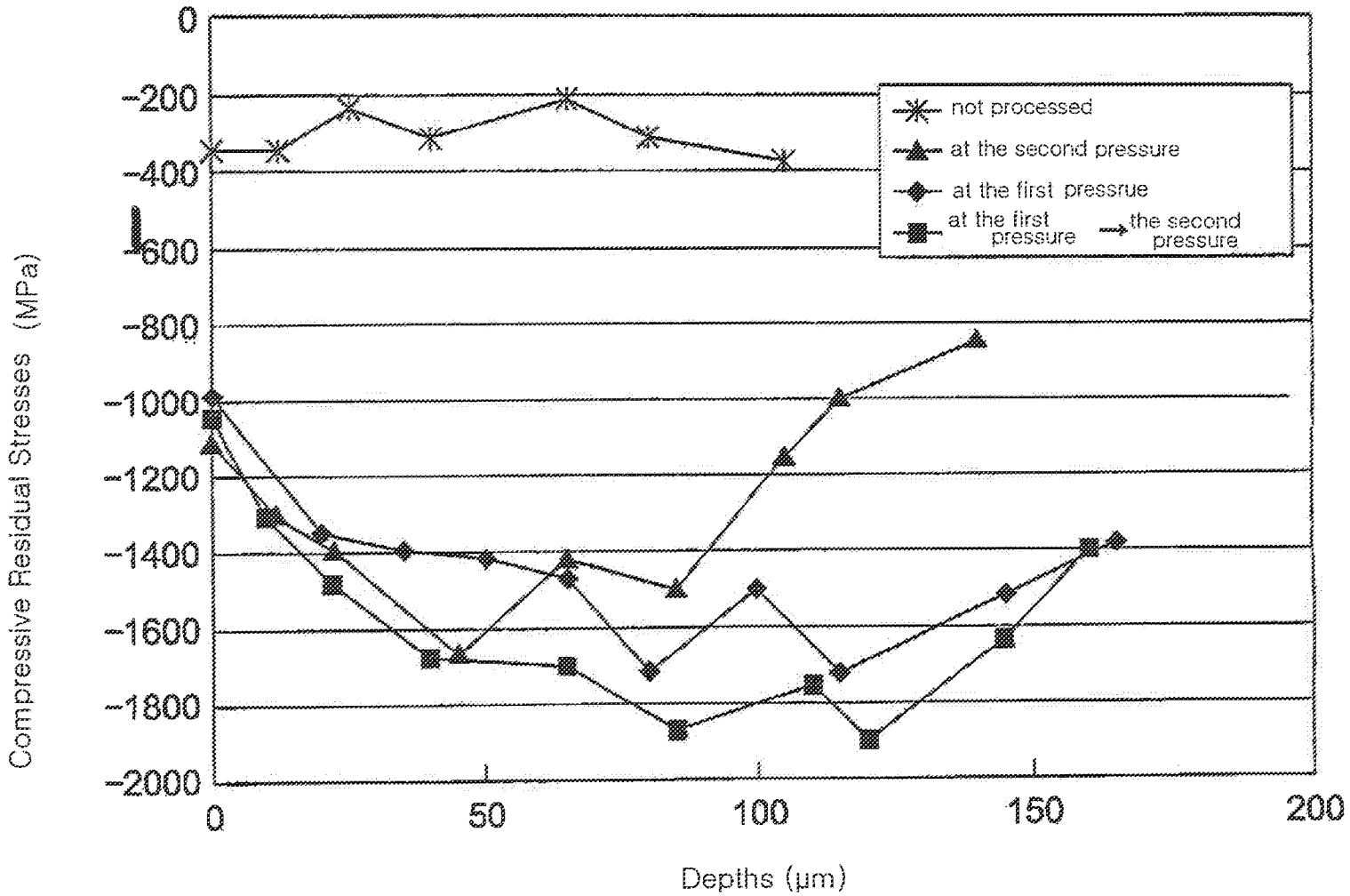
FIG. 10 shows other distributions in depth of the measurements of the compressive residual stresses of the work when the pressure by shots is changed.

FIG. 10 shows the distributions in depth of the measurements of the compressive residual stresses of the work that has not been processed and of the works that have processed at the second pressure for projecting the shots, at the first pressure for projecting the shots, and at the pressure that is changed from the first pressure for projecting the shots to the second pressure for projecting the shots. As seen from the figure, the compressive residual stresses at any depth of the work that has processed at the pressure that is changed from the first pressure for projecting the shots to the second pressure for projecting the shots are larger than those of the works that have been processed at the second pressure for projecting the shots and at the first pressure for projecting the shots. That is, by processing the work by shot-peening at the second pressure for projecting the shots that is lower than the first pressure for projecting the shots after processing the work by shot-peening at the first pressure for projecting the shots, the compressive residual stress becomes greater.

Thus, when, after the work 22 is processed by projecting the shots at the first pressure, the work 22 is processed by shot-peening at the second pressure that is lower than the first pressure the surface roughness of the work 22 is decreased and an intended distribution of compressive residual stresses is obtained.

Next, variations of the first embodiment of the present invention are discussed.

The shot-peening machine 10 of the embodiment is configured to, in sequence, process the work by projecting the shots at the first and second pressures that have been input to the operating unit 16 before the work is processed. However, it may be configured as follows. That is, when the first pressure for projecting the shots is input to the operating unit 16 the shot-peening machine 10 processes the work by projecting the shots at the first pressure that is input. Then, when the second pressure for projecting the shots is input to the operating unit 16 the shot-peening machine 10 processes the work by projecting the shots at the second pressure that is input.

In the embodiment, the flow control valves 28, 30 and the valve 32 for controlling the amount of shots are controlled by the control unit 18. However, they may be adjusted by an operator.

The shot-peening machine 10 is discussed as an air-type wherein the shots are projected by compressed air. However, it may be an impeller-type wherein the shots are projected by an impeller. In this case, after the work 22 is processed by shot-peening at the first speed for projecting the shots it is processed by shot-peening at the second speed for projecting the shots that is slower than the first one. The speed for projecting the shots can be adjusted by changing the speed of the rotation of the impeller.

The shot-peening machine 10 can change the pressure for projecting the shots at two levels. However, it may also change the pressure for projecting the shots at three or more levels.

The shot-peening machine 10 may be constructed as follows. In the variation in FIG. 2, the downstream end of the connecting piping 36 branches into a first connecting piping 36A and a second connecting piping 36B. The ends of the first and second connecting piping 36A, 36B are connected to a first inlet 40A and a second inlet 40B of the tank 26, respectively. A first flow control valve 30A and a second flow control valve 30B are provided on the first connecting piping 36A and the second connecting piping 36B, respectively. The first connecting piping 36A and the first flow control valve 30A are used for a process carried out at a high pressure, and the second connecting piping 36B and the second flow control valve 30B are used for a process carried out at a low pressure.

When the shots are projected at the first pressure for projecting the shots, which pressure is high, the control unit 18 opens the first flow control valve 30A and closes the second flow control valve 30B, to control them. When the shots are projected at the second pressure for projecting the shots, which pressure is low, the control unit 18 closes the first flow control valve 30A and opens the second flow control valve 30B, to control them.

Figure 3:
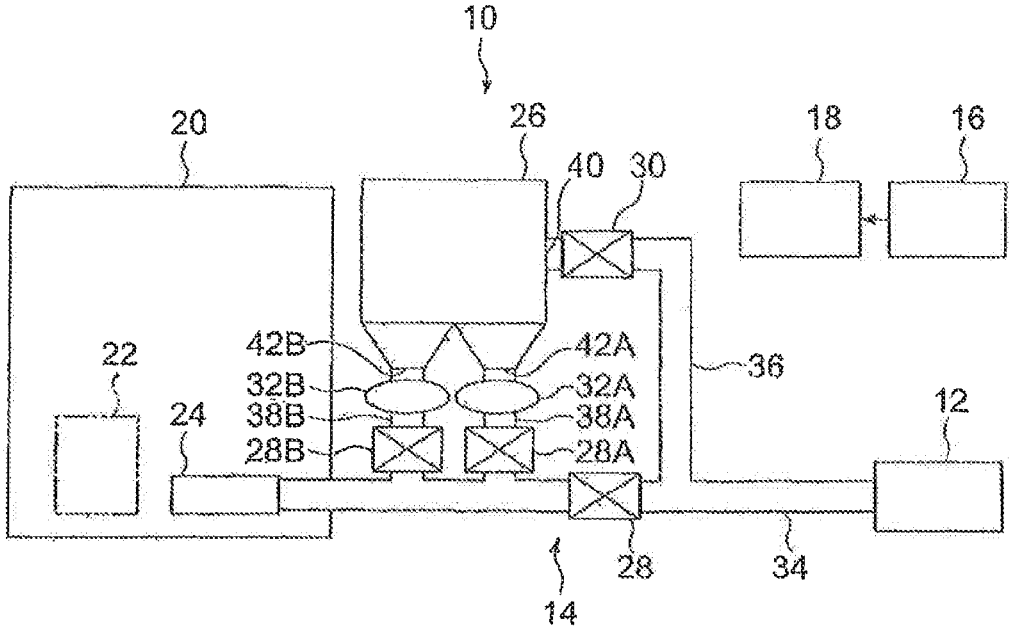
FIG. 3 illustrates the second variation of the shot-peening machine according to the first embodiment of the present invention.

In the variation in FIG. 3, the tank 26 has a first outlet 42A and a second outlet 42B. The first outlet 42A is connected to the connecting piping 34 via a first connecting piping 38A. The second outlet 42B is connected to the connecting piping 34 via a second connecting piping 38B. On the first connecting piping 38A a first flow control valve 28A and a first valve 32A for controlling the amount of shots are provided. On the second connecting piping 38B a second flow control valve 28B and a second valve 32B for controlling the amount of shots are provided. The first connecting piping 38A, the first flow control valve 28A, and the first valve 32A for controlling the amount of shots are all used for a process carried out at a high pressure, and the second connecting piping 38B, the second flow control valve 28B, and the second valve 32B for controlling the amount of shots are all used for a process carried out at a low pressure.

When the shots are projected at the first pressure for projecting the shots, which pressure is high, the control unit 18 opens the first flow control valve 28A and the first valve 32A for controlling the amount of shots and closes the second flow control valve 28B and the second valve 32B for controlling the amount of shots, to control them. When the shots are projected at the second pressure for projecting the shots, which pressure is low, the control unit 18 closes the first flow control valve 28A and the first valve 32A for controlling the amount of shots and opens the second flow control valve 28B and the second valve 32B for controlling the amount of shots, to control them.

Figure 4:
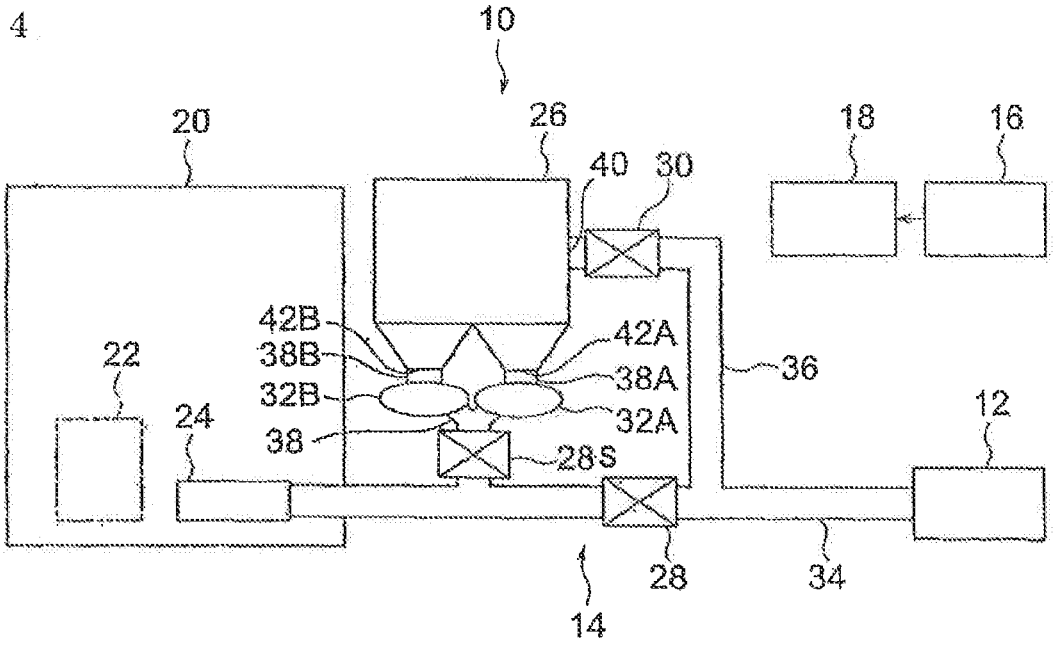
FIG. 4 illustrates the third variation of the shot-peening machine according to the first embodiment of the present invention.

In the variation in FIG. 4, the portion of the connecting piping 38 that is near the tank 26 branches into a first connecting piping 38A and a second connecting piping 38B. The first connecting piping 38A is connected to the first outlet 42A of the tank 26. The second connecting piping 38B is connected to the second outlet 42B of the tank 26. On the first connecting piping 38A a first valve 32A for controlling the amount of shots is provided. On the second connecting piping 38B a second valve 32B for controlling the amount of shots is provided. The first connecting piping 38A and the first valve 32A for controlling the amount of shots are used for a process carried out at a high pressure. The second connecting piping 38B and the second valve 32B for controlling the amount of shots are used for a process carried out at a low pressure. On the portion of the connecting piping 38 that is nearer the connecting piping 34 than the first connecting piping 38A or the second connecting piping 38B a flow control valve 28S is provided.

When the shots are projected at the first pressure for projecting the shots, which pressure is high, the control unit 18 opens the first valve 32A for controlling the amount of shots and closes the second valve 32B for controlling the amount of shots, to control them. When the shots are projected at the second pressure for projecting the shots, which pressure is low, the control unit 18 closes the first valve 32A for controlling the amount of shots and opens the second valve 32B for controlling the amount of shots, to control them.

Figure 2:
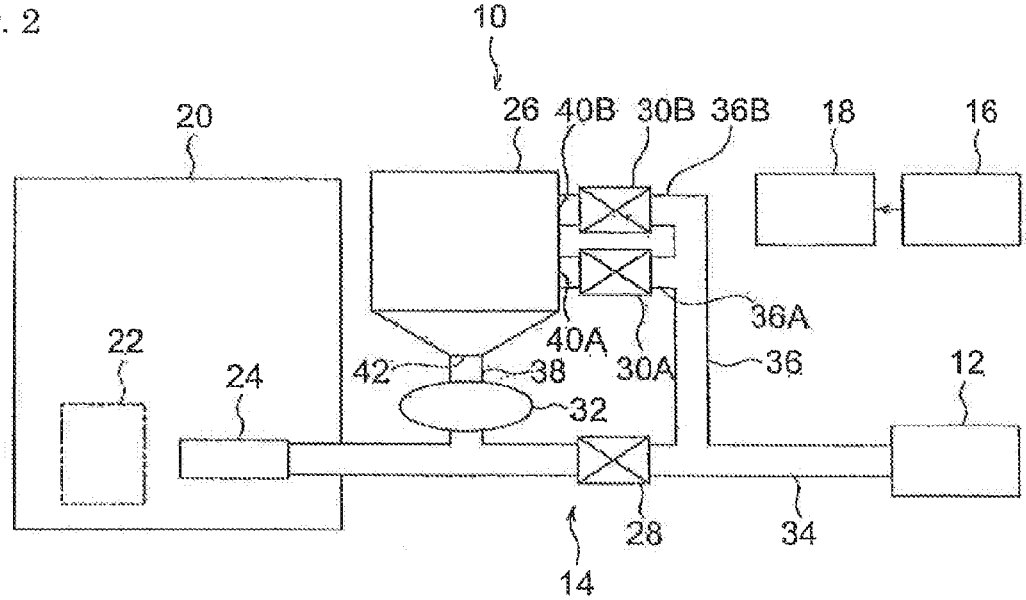
FIG. 2 illustrates the first variation of the shot-peening machine according to the first embodiment of the present invention.
Figure 5:
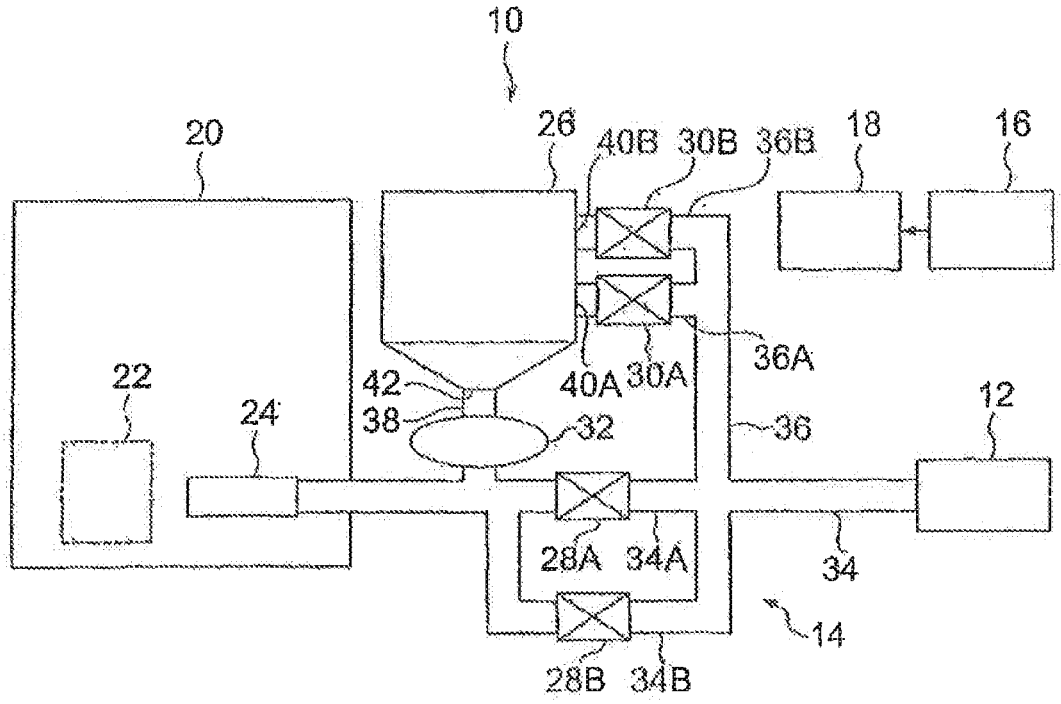
FIG. 5 illustrates the fourth variation of the shot-peening machine according to the first embodiment of the present invention.

In the variation in FIG. 5, the variation in FIG. 2 is modified as follows. A middle portion in the longitudinal direction of the connecting piping 34 branches into a first connecting piping 34A and a second connecting piping 34B that is provided in parallel with the first connecting piping 34A. On the first connecting piping 34A a first flow control valve 28A is provided. On the second connecting piping 34B a second flow control valve 28B is provided. The first connecting piping 34A and the first flow control valve 28A are used for a process carried out at a high pressure. The second connecting piping 34B and the second flow control valve 28B are used for a process carried out at a low pressure.

When the shots are projected at the first pressure for projecting the shots, which pressure is high, the control unit 18 opens the first flow control valves 28A, 30A and closes the second flow control valves 28B, 30B, to control them. When the shots are projected at the second pressure for projecting the shots, which pressure is low, the control unit 18 closes the first flow control valves 28A, 30A and opens the second flow control valves 28B, 30B, to control them.

Figure 6:
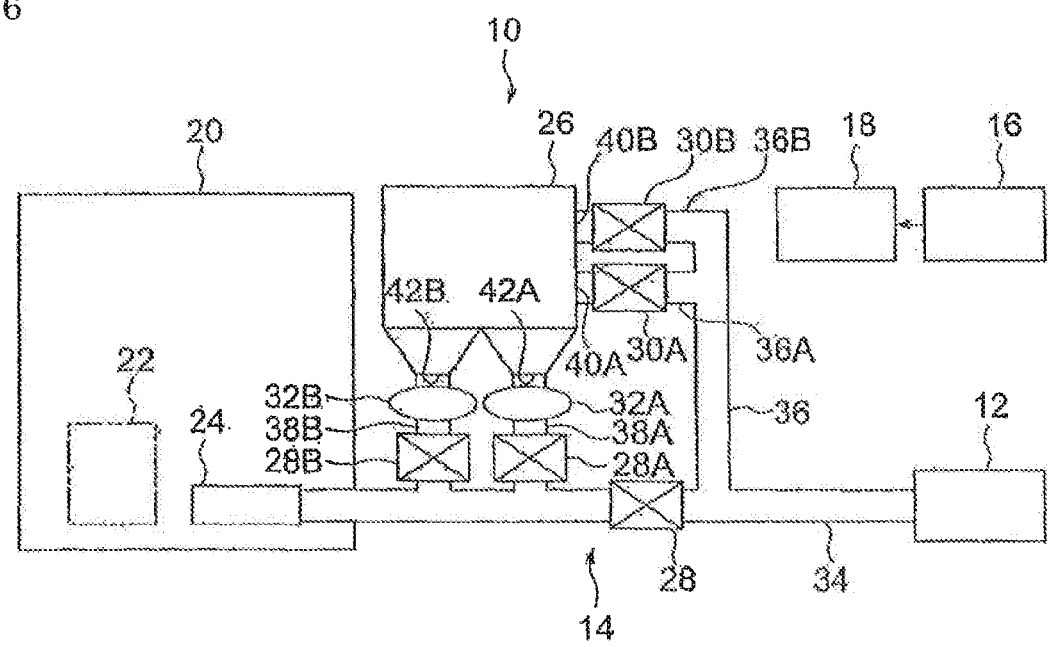
FIG. 6 illustrates the fifth variation of the shot-peening machine according to the first embodiment of the present invention.

In the variation in FIG. 6, the variation in FIG. 2 and the variation in FIG. 3 are combined.

When the shots are projected at the first pressure for projecting the shots, which pressure is high, the control unit 18 opens the first flow control valves 28A, 30A and the first valve 32A for controlling the amount of shots and closes the second flow control valves 28B, 30B and the second valve 32B for controlling the amount of shots, to control them. When the shots are projected at the second pressure for projecting the shots, which pressure is low, the control unit 18 closes the first flow control valves 28A, 30A and the first valve 32A for controlling the amount of shots and opens the second flow control valves 28B, 30B and the second valve 32B for controlling the amount of shots, to control them.

When the shot-peening machine is constructed as in FIGS. 2 to 6, the same functions and advantageous effects as those of the first embodiment of the present invention can be achieved.

Second Embodiment

Next, the second embodiment of the present invention is described.

Figure 7:
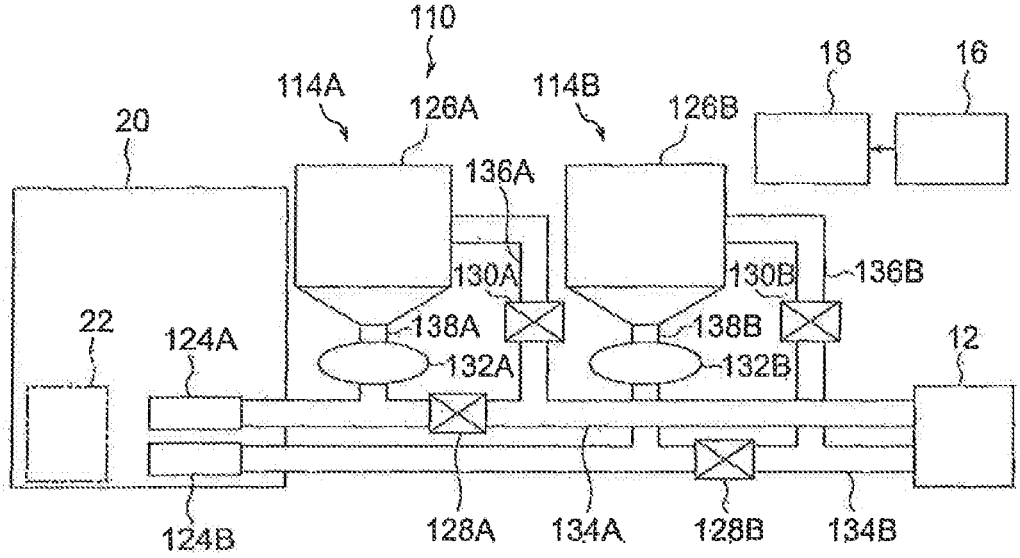
FIG. 7 is a block diagram of the shot-peening machine according to the second embodiment of the present invention.

The shot-peening machine 110 as in FIG. 7 that is the second embodiment of the present invention is modified in its construction from the shot-peening machine 10 (see FIG. 1) of the first embodiment of the present invention as follows.

That is, the shot-peening machine 110 comprises a first projecting unit 114A and a second projecting unit 114B. The first projecting unit 114A comprises a first nozzle 124A, a first tank 126A, first flow control valves 128A, 130A, a first valve 132A for controlling the amount of shots, and connecting piping 134A, 136A, 138A. The second projecting unit 114B comprises a second nozzle 124B, a second tank 126B, second flow control valves 128B, 130B, a second valve 132B for controlling the amount of shots, and connecting piping 134B, 136B, 138B.

The first projecting unit 114A and the second projecting unit 114B are constructed the same as the projecting unit 14 of the first embodiment of the present invention. The first projecting unit 114A is used for a process at a high pressure. The second projecting unit 114B is used for a process at a low pressure.

When the shots are projected at the first pressure for projecting the shots, which pressure is high, the control unit 18 opens the first flow control valves 128A, 130A and closes the second flow control valves 128B, 130B, to control them. When the shots are projected at the second pressure for projecting the shots, which pressure is low, the control unit 18 closes the first flow control valves 128A, 130A and opens the second flow control valves 128B, 130B, to control them.

In short, in the shot-peening machine 110 the work 22 is processed by the shots that are projected toward the work 22 at the first pressure by the first projecting unit 114A. Then it is processed by shot-peening wherein the shots are projected toward the work 22 by the second projecting unit 114B at the second pressure that is lower than the first pressure.

The shots that have been projected onto the work 22 are returned to the tanks 126A, 126B by a mechanism for recovering shots, which is not shown. By this shot-peening machine 110, no removal or supply of the shots is carried out, but the same shots are used.

When the shot-peening machine is constructed as discussed above, the same functions and advantageous effects as those of the first embodiment of the present invention can be achieved.

In the second embodiment of the present invention, the shot-peening machine 110 may be configured as follows. When the first pressure for projecting the shots is input to the operating unit 16 the shot-peening machine 110 projects the shots at the first pressure that is input. Then, when the second pressure for projecting the shots is input to the operating unit 16 the shot-peening machine 110 projects the projects at the second pressure that is input.

The shot-peening machine 110 is discussed as an air-type wherein the shots are projected by compressed air. However, it may be an impeller-type wherein the shots are projected by an impeller. Thus the first and second projecting units 114A, 114B may be first and second centrifugal projecting machines that have respective impellors in the first and second nozzles 124A, 124B, respectively.

In this case the first projecting unit 114A projects the shots onto the work 22 at the first speed for projecting the shots to process the work 22 by shot-peening. Then the second projecting unit 114B projects the shots onto the work 22 at the second speed for projecting the shots that is slower than the first speed to process the work 22 by shot-peening.

The shot-peening machine 110 can change the pressure for projecting the shots at two levels. However, it may also change the pressure for projecting the shots at three or more levels.

In the shot-peening machine 10 and the shot-peening machine 110, the pressures for projecting the shots can be changed by the flow control valves 28, 30, 28A, 28B, 30A, 30B, 128A, 130A, 128B, 130B that are located on the connecting piping 34, 36, 38, 34A, 34B, 36A, 36B, 38A, 38B, 134A, 136A, 138A, 134B, 136B, 138B. However, it may be changed by the device 12 for supplying compressed air. In this case the device 12 for supplying compressed air is a part of the projecting unit. In this case, the configuration of the shot-peening machine may be the same as that in FIG. 1 or a configuration wherein the flow control valves 28, 30 are eliminated from that in FIG. 1. If the device 12 for supplying compressed air consists of a compressor or blower, the first pressure for projecting the shots and the second pressure for projecting the shots are obtained by changing an output pressure.

Exemplary embodiments of the present invention have been discussed. The present invention must not be limited to them. The present invention can obviously be worked with many kinds of variations other than those that have been discussed, unless they extend beyond the scope of the present invention.

The invention claimed is:

1. A shot-peening machine for projecting shots that have been stored in a tank at a first pressure and at a second pressure that is lower than the first pressure by using compressed air from a device for supplying compressed air, the shot-peening machine comprising:

a tank for storing the shots;

a nozzle for projecting the shots onto a work;

a first connecting piping for transporting the compressed air from the device for supplying compressed air to the nozzle;

a flow control valve that is located on the first connecting piping;

a second connecting piping that branches from the first connecting piping at a point between the flow control valve and the device for supplying compressed air;

a flow control valve that is located on the second connecting piping;

a third connecting piping that connects an outlet of the tank to the first connecting piping at a point between the flow control valve on the first connecting piping and the nozzle;

a valve for controlling an amount of the shots, which valve is located on the third connecting piping; and a control unit for controlling the flow control valve on the first connecting piping, the flow control valve on the second connecting piping, and the valve for controlling an amount of the shots so as to control an amount of the shots to be projected at the first pressure and an amount of the shots to be projected at the second pressure.

2. The shot-peening machine of claim 1, wherein the second connecting piping braches into two respective second connecting piping for the first pressure and the second pressure, wherein both of the two second connecting piping are connected to the tank, and wherein two flow control valves are provided to the two second connecting piping for the first pressure and the second pressure, respectively, instead of the flow control valve on the second connecting piping.

3. The shot-peening machine of claim 1 or 2, wherein the tank has two outlets, wherein two third connecting piping are connected to the two outlets, respectively, wherein the two third connecting piping are connected to the first connecting piping, wherein two valves for controlling an amount of the shots are provided to the two third connecting piping for the first pressure and the second pressure, respectively, and wherein two flow control valves are provided to the two third connecting piping, respectively, for the first pressure and the second pressure at points between the valves for controlling an amount of the shots and connections to the first connecting piping (34).

4. The shot-peening machine of claim 3, wherein the two third connecting piping are joined so as to be one third connecting piping (38), wherein a flow control valve is provided to the one third connecting piping instead of the flow control valves, and wherein the two third connecting piping are joined between the valves for controlling an amount of the shots and the flow control valve.

5. The shot-peening machine of claim 2, wherein the first connecting piping has a branch in addition to the branch to the second connecting piping, two flow control valves are provided to the branched first connecting piping for the first pressure and the second pressure, respectively, and wherein the branches of the first connecting piping join between the flow control valves and the connection to the third connecting piping so as to function as one first connecting piping.

6. The shot-peening machine of claim 1, wherein two tanks for the first pressure and the second pressure are provided instead of the tank, and wherein two first connecting piping, two second connecting piping, and two third connecting piping, for the first pressure and the second pressure, are provided.

* * * * *